US005094696A

United States Patent [19]

Orsen

[11] Patent Number: 5,094,696

[45] Date of Patent: Mar. 10, 1992

[54] METHOD OF REMOVING PAINT

[75] Inventor: Mikael Orsen, Kungalv, Sweden

[73] Assignee: AGA Aktiebolag, Lidingo, Sweden

[21] Appl. No.: 598,714

[22] PCT Filed: Apr. 25, 1988

[86] PCT No.: PCT/SE88/00209

§ 371 Date: Dec. 21, 1990

§ 102(e) Date: Dec. 21, 1990

[87] PCT Pub. No.: WO89/10271

PCT Pub. Date: Nov. 2, 1989

[51] Int. Cl.[5] ..... B08B 7/00; C23G 1/36; C23D 17/00

[52] U.S. Cl. ..... 134/38; 134/7; 134/10; 51/319

[58] Field of Search ..... 134/38, 7, 10; 51/323, 51/319, 320, 324

[56] References Cited

U.S. PATENT DOCUMENTS 2,083,407 6/1937 Scrantom ..... 134/6
4,731,125 3/1988 Carr ..... 134/7
5,011,542 4/1991 Weil ..... 134/38

FOREIGN PATENT DOCUMENTS 3212171 1/1982 Fed. Rep. of Germany .
PCT/US84/-01006 1/1985 PCT Int'l Appl. .

*Primary Examiner*—Prince Willis, Jr.
*Assistant Examiner*—P. L. Hailey
*Attorney, Agent, or Firm*—Calfee, Halter & Griswold

[57] ABSTRACT

The invention relates to a blasting method for removing coatings of paint, varnish or like substances from objects coated with such substances, in which the objects are cooled in a condensed gas, e.g. liquid nitrogen, and then subjected, in a chilled state, to the effect of a blasting agent, e.g. steel shot, delivered by a blasting machine. The coating fragments dislodged are collected together with the blasting agent and mutually separated one from the other in a separator. The recovered blasting agent is then returned to the blasting machine. The method is characterized by adding an absorbent to the blasting agent in the blasting machine.

14 Claims, No Drawings

METHOD OF REMOVING PAINT

BACKGROUND OF THE INVENTION

The present invention relates to a method for shot blasting objects for the purpose of removing coatings of paint, varnish or like substances therefrom, in which said objects are cooled in a condensed gas, for instance liquid nitrogen, and thereafter subjected, in a chilled state, to the effect of a blasting agent, such as steel shot, pellets or like particles delivered from a shot blasting machine, and in which method coating fragments and blasting shot are collected and separated from one another and the shot returned to the blasting machine. Such paint removing methods are used, for example, in the car manufacturing industry, in which painting or varnishing of car bodies is carried out with the car bodies suspended from fixtures intended for this purpose. As the car bodies are sprayed, the fixtures become coated progressively with successive layers of paint or varnish, which finally have to be removed from the fixtures. Removal of these paint or varnish layers is effected by immersing the fixtures into a liquid nitrogen bath, until the fixtures are sufficiently chilled, whereafter the fixtures are blasted with steel shot or some like blasting agent, delivered by a blasting machine.

Blasting is effected, by throwing or slinging the shot against the paint coating on the fixtures, said coating having become brittle as a result of its exposure to the low bath temperature. Contact of the shot with the paint layers causes the paint to break up into fragments and dust, which fall to the floor together with the shot. It is then necessary to separate the shot from the paint debris. This is achieved by transporting the shot and paint debris to a drum sieve, in which larger paint fragments are removed, and then to a wind sieve, in which paint dust and shot fragments are separated from useful blasting shot. The blasting shot is transported from the wind sieve to the shot magazine of the blasting apparatus, from where the shot is conveyed to the throwing wheel, operative to throw the shot against the fixtures.

However, in addition to coatings of paint and similar coating substances, these fixtures also become coated with anti-rust oils and greases, or other types of oil and greases, which when the fixtures are immersed in liquid nitrogen become brittle and hard. When the fixtures are subsequently shot blasted, to remove the paint and varnish coatings, the oil loosens together with the paint and softens or melts such as to form together with paint dust and blasting shot a heavy dough-like mass which tends to fasten in the shot transporting and separating equipment, therewith creating disturbances in the operation thereof.

Furthermore, the oil which accompanies the shot to the shot magazine of said blasting machine causes the shot to pack into adhesively bonded aggregates. These aggregates, or lumps of shot, interrupt the smooth delivery of the shot to the throwing wheel of the blasting machine, therewith varying the efficiency of the blasting operation. Furthermore, interruptions in operation are often caused by blockaging of the blasting shot circulating system.

SUMMARY OF THE INVENTION

The object of the present invention is to provide a method for preventing the oil present from resulting in interruptions in operation.

This object is achieved by a shot blasting method intended for the removal of paint, varnish, or like substances from objects coated therewith, said method comprising chilling the objects in a condensed gas, for instance liquid nitrogen, and then subjecting said objects, in a chilled state, to the action of a blasting agent, for instance steel shot, delivered by a blasting machine, and by collecting resultant coating fragments and blasting agent and mutually separating said fragments and said blasting agent in a separator, and returning the blasting agent to the blasting machine. The method is characterized by adding an absorbent to the blasting agent in the blasting machine.

DETAILED DESCRIPTION OF THE INVENTION

The absorbent used is a preparation capable of absorbing technical oils. Preferred absorbents are mineral preparations. The absorbent used will preferably be in the form of granules. A particularly preferred absorbent is a preparation sold under the trade name ABSOL, which is a mineral granulate effective in absorbing technical oils.

When carrying out the method according to the present invention, one liter of absorbent can be added to the shot magazine for each blasting period of three minutes. The absorbent functions to absorb the oil present in the shot and accompanies the shot to the throwing wheel of the blasting machine and is crushed to a fine dust during the actual blasting operation, this dust absorbing further oil from the shot-blasted objects. The oil-containing absorbent is then separated from the shot, together with paint dust, in a wind sieve. The separated dust is then collected in a bag filter and transported away.

In the case of the example described above, all absorbent will have been slung against the fixtures after a time period of about 0.5 minutes. Consequently, no absorbent will be present during the remainder of the shot blasting period. The absorbent is nevertheless efficient, because the oil is often present solely on the outer surfaces of the fixtures and is consequently removed first.

The absorbent may be added continuously or discontinuously in batches, during the whole of the period during which shot is thrown from the blasting machine against the object being de-coated.

Such prevention of blockaging of the shot transporting system of said shot blasting machine and prevention of irregular feed to the shot throwing wheels will also reduce the mechanical wear on the transporting and separating system.

The shot used in the aforedescribed example has a diameter of 0.5–1.0 mm. It will be understood, however, that other blasting agents may be used, such as sand for instance.

The present invention can also be applied when the coatings to be removed are laden with grease or lubricant or other substances capable of adhesively binding together the shot and coating material removed thereby. Naturally, one condition for successfully avoiding the problem of adhesion is to use an absorbent capable of absorbing the substance causing the adhesion or to remove or modify said substance in some other way, so that said substance will no longer have a disturbing effect.

I claim:

1. A blasting method for removing coatings from objects comprising the steps of:

cooling the objects in a condensed gas, blasting said objects, in a chilled state, with a blasting agent, delivered by a blasting machine, collecting coating fragments and blasting agents and mutually separating said fragments and said blasting agent in a separator, returning the blasting agent to the blasting machine, and adding an absorbent to the blasting agent.

2. A method according to claim 1, characterized by adding a granular absorbent to said blasting agent.

3. A method according to claim 1 or 2, characterized by adding an oil absorbing substance to said blasting agent.

4. A method according to claim 1 or 2, characterized by adding a mineral absorbent to the blasting agent.

5. A method according to claim 1 further comprising the step of continuously adding absorbent to the blasting agent.

6. A method according to claim 1 further comprising the step of periodically adding absorbent, to the blasting agent the times of such periodic addition being equal to the time taken for the blasting agent to circulate in the blasting machine.

7. A method according to claim 1 further comprising the step of periodically adding absorbent to the blasting agent, the times of said periodic addition corresponding to the treatment time of said object.

8. The method according to claim 1, wherein the condensed gas is liquid nitrogen.

9. The method of claim 1, wherein the blasting agent is steel shot.

10. A method according to claim 1, wherein the blasting machine is a shot blasting machine.

11. The method according the claim 1, wherein the blasting machine has a blasting agent magazine.

12. The method according to claim 11, further comprising the step of continuously adding the absorbent to the blasting agent magazine.

13. The method according to claim 11, further comprising the step of periodically adding the absorbent to the blasting agent magazine.

14. The method according to claim 1, wherein the blasting agent is sand.

* * * * *